United States Patent [19]

Morane et al.

[11] Patent Number: 4,927,282

[45] Date of Patent: May 22, 1990

[54] CONTAINER FOR NAIL POLISH

[75] Inventors: Bruno Morane, Neuilly; Gérard Joulia, Paris, both of France

[73] Assignee: L'Oreal, Paris, France

[21] Appl. No.: 322,571

[22] Filed: Mar. 13, 1989

[30] Foreign Application Priority Data

Mar. 11, 1988 [FR] France ..... 88 03192

[51] Int. Cl.[5] ..... A45D 34/00; A46B 11/00

[52] U.S. Cl. ..... 401/129; 401/4; 401/126

[58] Field of Search ..... 401/126, 129, 123, 124, 401/125, 220, 4, 219

[56] References Cited

U.S. PATENT DOCUMENTS

| | | | |
|---|---|---|---|
| 1,021,709 | 3/1912 | Snow | 401/129 |
| 2,691,184 | 10/1954 | Miller . | |
| 2,964,012 | 12/1960 | Kahn et al. | 401/4 X |
| 3,060,942 | 10/1962 | Finlay | 401/129 X |
| 3,147,511 | 9/1964 | Pittoni | 401/123 X |

FOREIGN PATENT DOCUMENTS

| | | | |
|---|---|---|---|
| 938658 | 2/1956 | Fed. Rep. of Germany . | |
| 1131324 | 2/1957 | France . | |
| 1517002 | 3/1968 | France . | |
| 2349511 | 11/1977 | France . | |
| 475661 | 2/1972 | Japan | 401/219 |
| 400123 | 10/1933 | United Kingdom | 401/129 |
| 2078175 | 1/1982 | United Kingdom | 401/219 |

OTHER PUBLICATIONS

Search Report–France, 11-17-88.

*Primary Examiner*—Steven A. Bratlie

*Attorney, Agent, or Firm*—Cushman, Darby & Cushman

[57] ABSTRACT

A container for nail polish includes a stopper (1) to which a brush (4) is affixed, and a bottle (2). The container has an elongated shape, similar to that of a fountain pen, and the bottle (2) is divided into two compartments (5, 6) by a valve (7), in particular a ball valve. The valve (7) is open when the stopper (1) of the container is in a lowered position with respect to the bottle (2).

9 Claims, 1 Drawing Sheet

CONTAINER FOR NAIL POLISH

FIELD OF THE INVENTION

The present invention relates to a container for nail polish.

BACKGROUND OF THE INVENTION

Containers for nail polish have long been known that include a bottle containing the nail polish and stopper, to which the brush is affixed by a rod, with the brush dipping into the bottle and consequently into the nail polish when the container is closed.

The bottles used most often have a pot-bellied shape, with a flat bottom so that they can stand on it. However, these bottles have two disadvantages. First, it is difficult to hold them in the hand while one varnishes the nails, and they are difficult to carry, for instance in a handbag, because they fit poorly and occupy a relatively large amount of space.

To make the bottle easier to carry and handle, it has been proposed that it have an elongated shape, similar to that of a fountain pen. In that case, however, there is one problem: to enable using the nail polish until it is completely exhausted, the brush must be relatively long. With an elongated and narrow bottle, it is difficult to tilt the bottle in order to make the brush dip into the nail polish when there is little nail polish left, so that the brush must accordingly be nearly as long as the bottle. However, it is practically impossible to assure correct polishing of the nails with a brush that has a long rod; the long lever arm presented by the length of the rod translates any changes in direction of the hand at the stopper into unacceptably wide swings at the brush end, making it very difficult to guide the brush accurately.

OBJECT AND SUMMARY OF THE INVENTION

The present invention has the object of proposing a container for nail polish of elongated shape that makes it possible to use a relatively short brush.

Accordingly, the present invention relates to a container for nail polish including a bottle containing the nail polish and a stopper provided with a brush connected to the stopper by a rod, where the brush dips into the bottle when the container is closed, characterized in that the bottle is elongated and is divided into two compartments along its length by a valve; the brush is contained entirely in the first compartment, which is the one closer to the stopper, and the valve is open when the stopper is in a lowered position with respect to the bottle to which it is affixed.

The valve is preferably a ball valve, comprising a ball and an annular bulge affixed to the inside wall of the elongated bottle; the bulge forms a circular opening, the diameter of which is less than that of the ball.

This valve preferably also includes a device intended to retain the ball when the ball valve is open, the device being affixed to the inside wall of the bottle. This device may comprise an annular collar or by curved tabs in the form of claws. These tabs are preferably disposed at regular intervals about the interior wall; suitably, there are four of them.

The second compartment preferably contains at least one ball; its function is to agitate the nail polish contained in this second compartment whenever the nail polish container is shaken.

The outer envelope of the bottle preferably comprises two tubular portions, the first tubular portion corresponding to the first compartment and being nested in the open end of the second tubular portion, which includes a bottom and corresponds to the second compartment.

In a first embodiment of the invention, the tubular portion corresponding to the first compartment is made in a single molded part that includes the annular bulge and the retaining device for the ball. In a second embodiment, the tubular portion corresponding to the first compartment is made of a tube, nested in which is a stopper that includes the ball valve element or seat, that is, the annular bulge, the ball, and the device for retaining the ball.

The tubular portion corresponding to the first compartment is preferably made of plastic material that, in the first embodiment described above, is totally transparent. In the second embodiment, only the tube is of transparent plastic material.

The novel container for nail polish according to the invention functions as follows: When the user tilts the container, after closing by putting the plug into position on the bottle, the ball clears the central opening of the circular bulge, and a portion of the nail polish contained in the second compartment passes into the first compartment. When the container is righted again, the ball again closes this central opening. The portion of nail polish contained in the first compartment is thus trapped above the valve, and it can be picked up with the brush in order to varnish the nails. When the first compartment no longer contains any nail polish, the user again tilts the container so as to cause a certain amount to flow into the first compartment. The first compartment accordingly serves to pick up the nail polish with the aid of the brush, while the second compartment comprises a reservoir for a reserve supply.

The invention will better understood from the ensuing detailed description of a purely illustrative and non-limiting example, taken in conjunction with the accompanying drawings.

DESCRIPTION OF THE PREFERRED EMBODIMENTS

Figure 1:
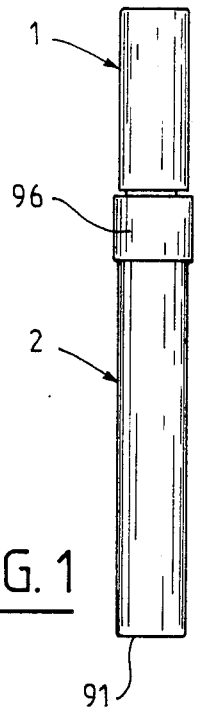
FIG. 1 is an external view of a container according to the invention, in the closed position.

The container for nail polish according to the invention includes a stopper, or cap, 1 and a bottle 2. The bottle is of elongated cylindrical form, and in overall shape is similar to a fountain pen. The stopper 1 and the bottle 2 have complementary closure elements 3 and 3'. In the embodiment shown, the stopper 1 and the bottle 2 have complementary threads. A brush 4 is affixed to the stopper 1 via a short rod. The bottle 2 is divided into two compartments 5 and 6 by a valve 7. The valve 7 is a ball valve, comprising an annular bulge defining a seat 71 affixed to the inside wall of the elongated bottle 2 and by a ball 72. The central circular opening 73 defined by the annular bulge 71 has a diameter less than that of the ball 72. In the embodiment shown in FIGS. 2 and 3, the ball valve 7 also includes a device for retaining the ball, comprising an annular collar 74 affixed to the inside wall of the bottle 2. This annular collar 74 defines a circular opening 75, which again has a diameter less than that of the ball 73. The brush 4 is contained entirely within the compartment 6. Hence it can be of merely a slight length, which is determined principally by the location of the ball valve 7 in the bottle 2. The length of the compartments 5 and 6 is variable. They may be of lengths approximately similar to one another, as shown in the accompanying drawings, or quite different lengths. The compartment 5 contains balls 8. Their purpose is to agitate the nail polish and to make it stay fluid by thixotropy.

The bottle 2 includes an outer envelope 9 of generally cylindrical shape, including a flat bottom 91 at one end and a restriction 92 having the thread 3'.

In the embodiment shown in the accompanying drawings, the outer envelope 9 comprises two tubular portions 93 and 94, assembled by being nested within one another and optionally glued, the tubular portion 93 covering the portion 94 over a certain length. The tubular portion 93, with the bottom 91, defines the second compartment 5. The tubular portion 94 defines the first compartment 6.

Figure 2:
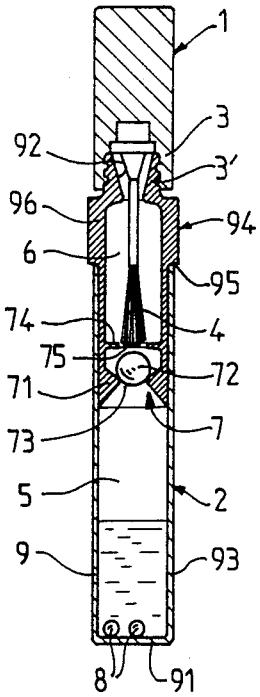
FIG. 2 is a view in longitudinal section of the container in a first embodiment of the present invention.
Figure 3:
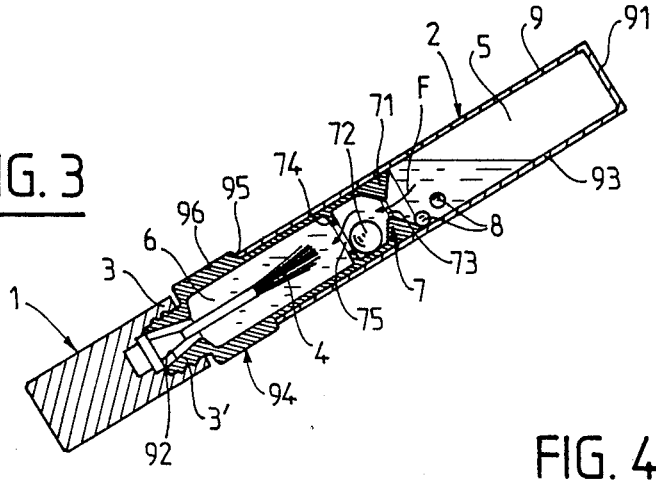
FIG. 3 is another longitudinal sectional view of a first embodiment of the container according to the invention, showing the functioning of the ball valve.

In the embodiment shown in FIGS. 2 and 3, the tubular portion 94 is molded from a single part, having the restriction 92 carrying the thread 3' at one end, and the annular collar 74 and the annular bulge 71 at the other end. This tubular portion 94 is molded from transparent material, such that the annular surface 96 that is not covered by the tubular portion 93 after nesting comprises a transparent window, through which the color of the nail polish can be seen. The tubular portion 94 includes a stop 95 for the cylindrical tubular portion 93, defining the second compartment.

Figure 4:
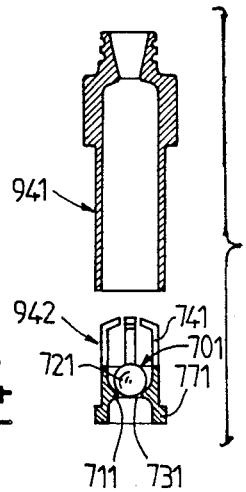
FIG. 4 is a view, partially in longitudinal section, of a second embodiment of a container according to the invention.

In the embodiment shown in FIG. 4, the tubular portion 94 comprising a tube 941, preferably of transparent plastic material, and a stopper 942 which includes the ball valve 701. It may be made of a material identical to or different from that of the tube 941. The stopper includes an annular bulge 711 that makes a circular opening 731, and four tabs in the form of claws 741 that retain the ball 721 when the ball valve is open. The stopper includes a cylindrical portion that is slightly smaller in diameter than the outside diameter of the tube 941, and a cylindrical portion 771 the outside diameter of which is equal to the outside diameter of the tube 941, such as to limit the depth to which the stopper 942 including the valve 701 is driven into the tube 941.

The nail polish container according to the present invention functions as follows. When the user tilts the container toward the stopper 1, the ball valve 7, 701, opens. The ball 72, 721 clears the opening 73, 731 and comes to be pressed against the ball retaining device 74, 741. The nail polish contained in the second compartment 5 flows in the direction of the arrows F (FIG. 3) via the circular openings 73, 731 or between the tabs in the form of claws 741.

When the user believes that the quantity of nail polish contained in the first compartment 6 is sufficient, he tilts the container in the opposite direction, and ball 72, 721 re-closes the opening 73, 731. The nail polish that has flowed into the first compartment 6 remains trapped in it. The user can now open the container, pick up the nail polish with the brush 4, and proceed to paint the nails.

What is claimed is:

1. A container for nail polish including a bottle for containing the nail polish and a stopper provided with a brush affixed with a rod whereby said brush is dipped into the bottle when the container is closed, the bottle being elongated in shape, and being divided along its length into a first and a second compartment separated by a valve means, the brush being contained entirely within the first compartment, which is the closest to the stopper, said valve means having a valve member which moves to a closed position when said container is substantially vertically upright with said first compartment disposed above said second compartment and to an open position at least when said second compartment is disposed at least partially above said first compartment.

2. A container as defined by claim 1, characterized in that the valve means is a ball valve comprising a ball and an annular bulge affixed to the inside wall of the bottle, said bulge defining a central circular opening, the diameter of which is less than that of the ball.

3. A container as defined by claim 2, characterized in that the ball valve includes a device for retaining the ball when the valve is open, the device being affixed to the inside wall of the bottle at a position closer to the stopper than the annular bulge.

4. A container as defined by claim 3, characterized in that the device for retaining the ball comprises an annular collar.

5. A container as defined by claim 3, characterized in that the device for retaining the ball comprises tabs curved in the form of claws.

6. A container as defined by one of the claims 1–5, characterized in that the second compartment contains at least one ball, intended for agitating the nail polish contained in the second compartment when the container is shaken.

7. A container as defined by one of claims 1–5 wherein the bottle includes an outer envelope which comprises a first and second tubular portion with the second tubular portion having an open end, the first tubular portion corresponding to the first compartment and being nested inside the open end of the second tubular portion, which includes a bottom and defines the second compartment.

8. A container for nail polish including a bottle for containing the nail polish and a stopper provided with a brush affixed with a rod whereby said brush is dipped into the bottle when the container is closed, the bottle being elongated in shape, and being divided along its length into a first and a second compartment separated by a valve means, the brush being contained entirely within the first compartment, which is the closest to the stopper, said valve means having a valve member which moves to a closed position when said container is substantially vertically upright with said first compartment disposed above said second compartment and to an open position at least when said second compartment is disposed at least partially above said first compartment;

wherein said valve means is a ball valve comprising a ball and an annular bulge affixed to the inside wall of the bottle, said bulge defining a central circular opening, the diameter of which is less than that of the ball;

wherein said ball valve includes a device for retaining the ball when the valve is open, the device being affixed to the inside wall of the bottle at a position closer to the stopper than the annular bulge; wherein the bottle includes an outer envelope which comprises a first and second tubular portion with the second tubular portion having an open end, the first tubular portion corresponding to the first compartment and being nested inside the open end of the second tubular portion, which includes a bottom and defines the second compartment and wherein the tubular portion corresponding to the first compartment comprises a single molded part, which includes the annular bulge and the retaining device of the ball valve.

9. A container for nail polish including a bottle for containing the nail polish and a stopper provided with a brush affixed with a rod whereby said brush is dipped into the bottle when the container is closed, the bottle being elongated in shape, and being divided along its length into a first and a second compartment separated by a valve means, the brush being contained entirely within the first compartment, which is the closest to the stopper, said valve means having a valve member which moves to a closed position when said container is substantially vertically upright with said first compartment disposed above said second compartment and to an open position at least when said second compartment is disposed at least partially above said first compartment;

wherein said valve means is a ball valve comprising a ball and an annular bulge affixed to the inside wall of the bottle, said bulge defining a central circular opening, the diameter of which is less than that of the ball;

wherein said ball valve includes a device for retaining the ball when the valve is open, the device being affixed to the inside wall of the bottle at a position closer to the stopper than the annular bulge; wherein the bottle includes an outer envelope which comprises a first and second tubular portion with the second tubular portion having an open end, the first tubular portion corresponding to the first compartment and being nested inside the open end of the second tubular portion, which includes a bottom and defines the second compartment;

and wherein the tubular portion comprises a tube and a stopper means that includes the elements of the ball valve including the annular bulge, ball, and cage device for retaining the ball.

* * * * *